United States Patent [19]

Moore

[11] 4,391,072

[45] Jul. 5, 1983

[54] WINDOW TRIM

[75] Inventor: John W. Moore, Creve Coeur, Mo.

[73] Assignee: The Swan Corporation, St. Louis, Mo.

[21] Appl. No.: 220,807

[22] Filed: Dec. 29, 1980

[51] Int. Cl.[3] ..... E06B 1/04

[52] U.S. Cl. ..... 52/211; 52/716

[58] Field of Search ..... 52/204, 211, 212, 35, 52/716

[56] References Cited

U.S. PATENT DOCUMENTS

| | | | |
|---|---|---|---|
| 2,510,845 | 6/1950 | Waters et al. | 52/204 X |
| 2,851,742 | 9/1958 | Johnston | 52/211 |
| 3,139,703 | 7/1964 | Hilt | 52/211 X |
| 3,276,174 | 10/1966 | Cooney | 52/211 |
| 3,449,873 | 6/1969 | Damato et al. | 52/211 X |
| 3,740,908 | 6/1973 | Moore | 52/35 X |
| 4,193,238 | 3/1980 | Chalmers et al. | 52/211 |

*Primary Examiner*—Carl D. Friedman

*Attorney, Agent, or Firm*—Kalish & Gilster

[57] ABSTRACT

A window trim assembly comprising a pair of jamb trim components and a sill trim component for covering disposition upon the interior of jamb-forming and sill-forming portions of a window. The sill trim component comprises a main body portion adapted to be presented to an angle to the vertical for facilitating water drainage thereacross and having a depending apron along its normally outer longitudinal edge. Each trim component embodies a base flange for supported disposition upon an underlying end portion of the sill trim component and a depending skirt for presentation outwardly of the adjacent portion of the sill apron with such skirts incorporating inturned lips for underlying the bottom edge of the apron.

10 Claims, 11 Drawing Figures

WINDOW TRIM

BACKGROUND AND SUMMARY OF THE INVENTION

This invention relates in general to building construction and, more particularly, to an assembly of inter-related components for interior trim of windows.

With existing building construction there is consistently encountered the need to remodel the interior aspects of windows of the type incorporating the usual, relatively deep jambs and sills. It is exceedingly costly to undertake such efforts by resort to replacing wooden components and, therefore, there is the need to provide means for modernizing in a manner which will be most attractive, yet economically achieved.

Accordingly, it is an object of the present invention to provide a window trim assembly comprised of a paucity of inter-related components which may be economically manufactured from moldable materials and which may be easily modified for accommodating a wide range of window jamb and sill dimensions.

It is another object of the present invention to provide a window trim assembly of the character stated which may be fixedly secured upon existing structure in obscuring relationship thereto by means of easily applied adhesive material thereby facilitating installation, as well as presenting a pleasing appearance unblemished by visible securing means.

It is another object of the present invention to provide a window trim assembly of the character stated which is especially adapted for utilization with windows located in immediate adjacency to bathtubs, basins, showers and the like in being designed for promoting water drainage therefrom.

It is a further object of the present invention to provide a window trim assembly which may be easily installed by the average home owner without developed skill in the remodeling field.

It is a still further object of the present invention to provide a window trim assembly which is conducive to kit-formation so as to be available in the retail market as a typical "do it yourself" kit; as well as being available for facile usage by industry.

It is another object of the present invention to provide a window trim assembly of the character stated which is amenable to presentation in infinite color patterns as well as being provided with any preselected surface ornamentation thereby presenting a extreme versatility for compatibility with any predetermined decor.

It is another object of the present invention to provide a window trim assembly of the character stated which is durable and reliable in usage; which may be installed upon existing structures without prior costly modification thereof; and which is particularly amenable for utilization with wall paneling as of the type disclosed in U.S. Pat. Nos. 3,740,908 and 3,564,788.

DESCRIPTION OF THE PREFERRED EMBODIMENT

Figure 1:
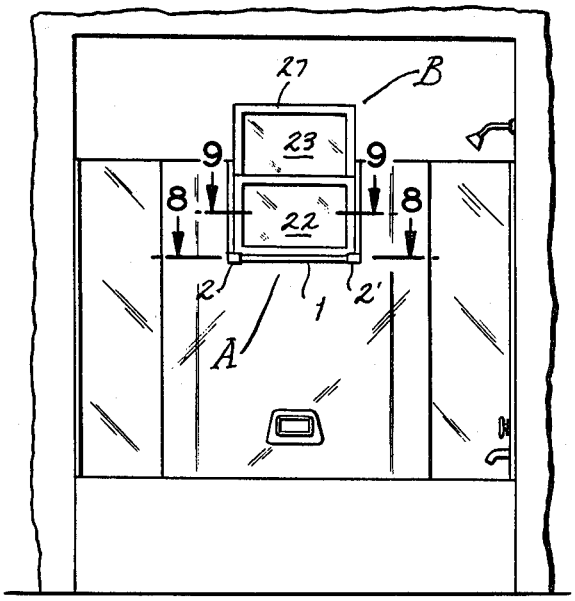
FIG. 1 is a front elevational view of window trim constructed in accordance with and embodying the present invention, illustrating the same in operative condition.
Figure 2:
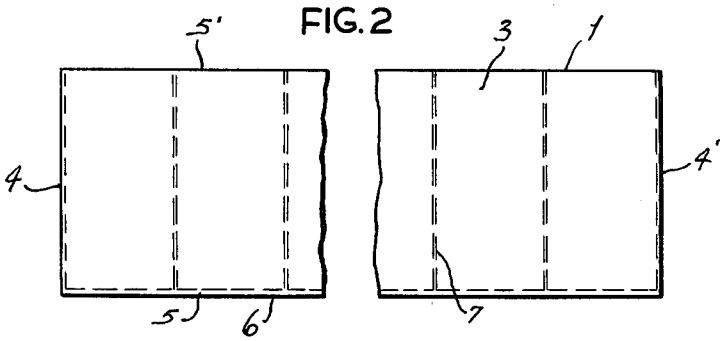
FIG. 2 is a top plan view of the horizontal trim component.
Figure 4:
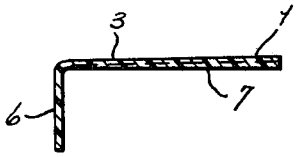
FIG. 4 is a vertical transverse sectional view taken on the line 4—4 of FIG. 3.
Figure 3:
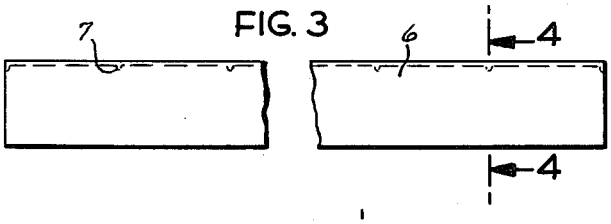
FIG. 3 is a front elevational view of the horizontal trim component.
Figure 3:
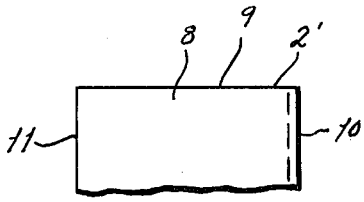
Figure 5:
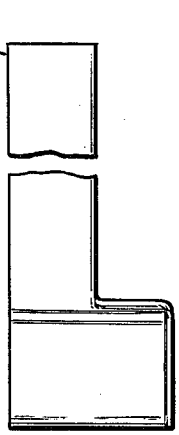
FIG. 5 is a front elevational view of one vertical trim component.
Figure 6:
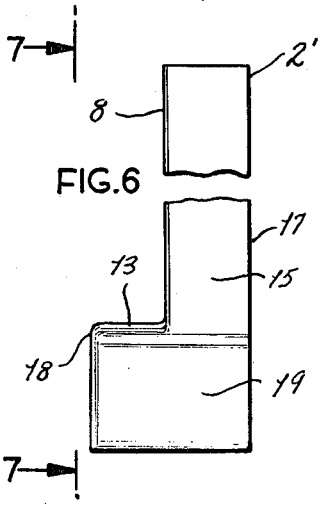
FIG. 6 is a front elevational view of the other vertical trim component.
Figure 7:
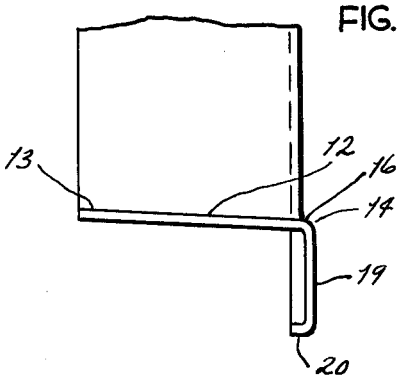
FIG. 7 is a vertical view taken on the line 7—7 of FIG. 6.
Figure 8:
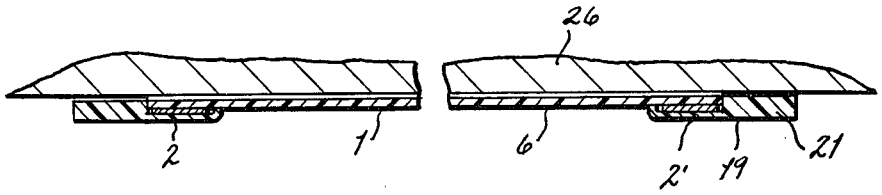
FIG. 8 is a horizontal transverse sectional view taken on the line 8—8 of FIG. 1.
Figure 9:
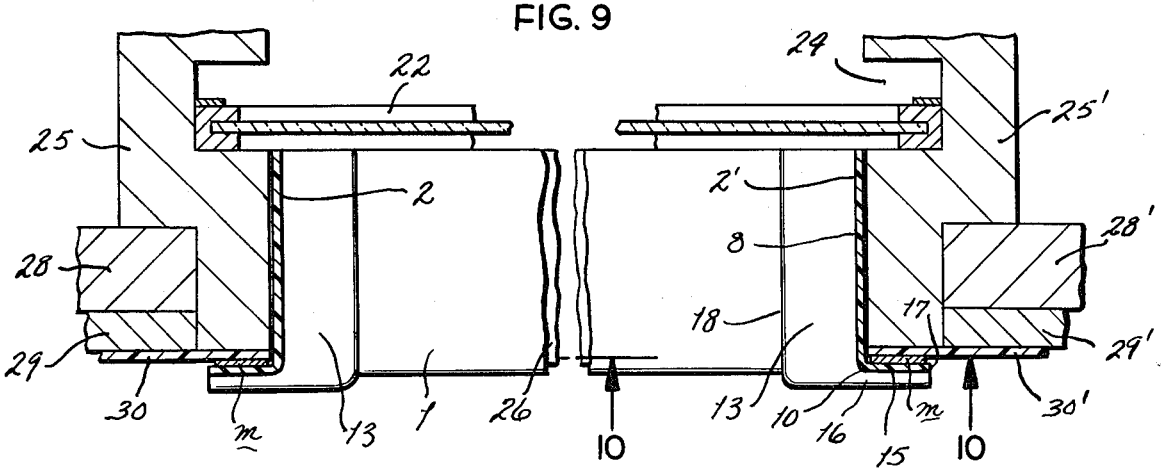
FIG. 9 is a horizontal transverse sectional view taken on the line 9—9 of FIG. 1.
Figure 10:
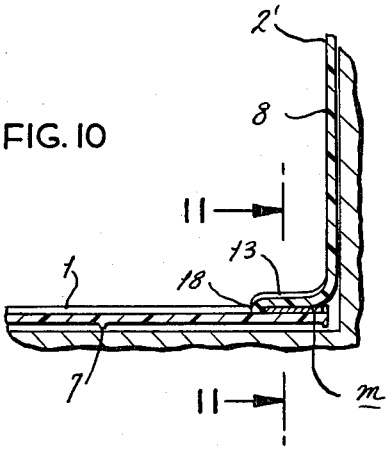
FIG. 10 is a vertical transverse sectional view taken on the line 10—10 of FIG. 9.

Referring now by reference characters to the drawings which illustrate the preferred embodiment of the present invention. A generally designates a window trim assembly comprised of three basic constituents, namely a horizontal or sill trim component 1 and a pair of vertical or jamb trim components 2,2'; which latter are of like construction but of reverse configuration for disposition against the opposed side jambs of a window to be treated. Therefore, although only one of said vertical trim components 2,2' will be described, it is to be understood that they are of like construction but with the elements thereof in opposed relationship in order to provide the understandably desirable symmetry when in operative position.

Horizontal or sill trim component 1, being preferably of molded fiberglass construction, thus being relatively thin but possessing considerable strength for assuring of durable usage, is of general angle-shape in cross-section comprising a body 3 of generally elongated panel or sheet form having end edges 4,4' and forward and rearward longitudinal edges 5,5', respectively. Depending from forward edge 5, coextensively therewith, is an apron 6. On the undersurface of body 3 and integral therewith is a plurality of longitudinally spaced-apart, transversely extending, relatively shallow ribs 7 which are downwardly and forwardly inclined, merging into apron 6 at the rearward surface thereof, for reasons presently appearing.

Each vertical or jamb trim component 2,2', being also desirably of molded fiberglass construction, comprehends an upstanding main panel portion 8 of generally rectangular configuration, having a top edge 9, vertical front and rear edges 10, 11 and a bottom edge portion 12, which latter continues with a flange-like base extension 13 extending from rearward edge 11 forwardly of forward edge 10 to a point, as at 14. The plane of extension 13 is at substantially the same angle to main panel portion 8 as the angle of inclination of ribs 7 with respect to body 3 of trim component 1 for purposes presently appearing. The forward vertical edge 10 of panel portion 8 is continuous throughout its length with a short, laterally out-turned flange 15 which is substantially planarwise normal to panel portion 8. At the lower end of flange 15, components 2,2' project slightly forwardly a distance coinciding with point 14 to provide a shallow, rounded shoulder 16 extending from the outer vertical margin 17 of flange 15 to the transverse free end edge 18 of extension 13. From shoulder 16 there depends a skirt 19 having a length corresponding to the combined width of flange 15 and extension 13. At the lower end extremity of skirt 19 there is formed a rearwardly turned lip 20. The transverse extent or height of skirt 19 is such that when the associated trim component 2 or 2', as the case may be, is disposed upon sill trim component 1, in assembly, lip 20 will project rearwardly beneath the bottom edge of apron 6 (see FIG. 11), as will be more fully discussed hereinbelow. Skirt 19 in its outer end portion is of greater thickness, as at 21, than the inner portion thereof, which latter receives apron 6 in assembly; said thickness portion 21 serving to effectively close what would otherwise be a cosmetically unappealing gap or spacing.

Referring now to FIG. 1, B generally identifies a window to be finished by trim assembly A of the present invention and is illustrated as being located upwardly of a bathtub, the enclosure or surround of which may have been suitably treated by wall paneling of the type shown in U.S. Pat. Nos. 3,740,908 and 3,564,788. Window B may be of any particular type, but for purposes of explanation is shown herein as having a lower vertically slideable sash 22 and an upper stationary sash 23 presented within the usual opening 24 provided within side jambs 25,25'; there being the customary sill 26 and header, as suggested at 27. It is to be understood that the construction of window B does not form a part of the present invention but is set forth solely for purposes of exposition and thus window B serves merely to demonstrate the relationship of trim components 1, 2 and 2' for decoratively finishing a window in a manner which will be fully comprehensible for those skilled in the art. Thus, jambs 25,25' may be engaged to conventional studding 28,28' for supporting conventional drywall, such as wallboards 29,29'. Suitably affixed upon said wallboards 29,29', as by compatible adhesives or cementitious material, may be wall panels 30,30' as of the type set forth in the aforementioned U.S. patents. But it should be recognized that trim assembly A need not necessarily be utilized with such wall panels, but the same is particularly suitable therewith.

In actual installation, sill trim component 1 may be easily pared or reduced in length and/or in transverse extent for accommodating windowsill 26 with body 3 being coveringly disposed thereon in supported position by ribs 7, but with the length of said component 1 being less than that of sill 26 so that the end edges 4,4' may be disposed a slight distance from the proximate jamb 25,25', respectively, as in the order of $\frac{1}{2}$ to 1", but of a distance less than the transverse extent of base flanges 13 of jamb trim components 2,2'. With sill trim component 1 so mounted, apron 6 on its rearwardly directed surface will abut against the confronting edge portion of sill 26. To assure against inadvertent or accidental displacement of trim component 1 as so mounted, mastic, foam tape, or other pressure sensitive materials (not shown) may be used to effect a reliable joint between said component 1 and sill 26.

Figure 11:
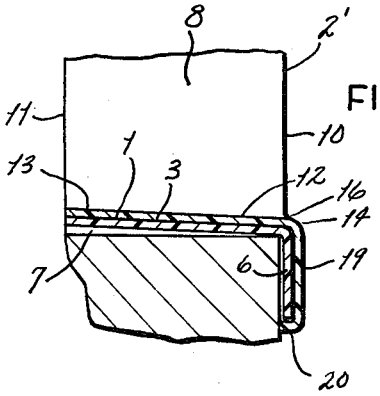
FIG. 11 is a vertical transverse sectional view taken on the line 11—11 of FIG. 10.

The installer will then pare or suitably trim jamb trim components 2,2' so that the transverse extent of portion 8 and base flange 13 will be flush along the rearward margins thereof with the related window jamb 25,25', as the case may be. The installer will then present trim component 2' to sill trim component 1 at one end thereof and in vertical relation thereto, with lip 20 extending beneath the bottom edge of apron 6 of component 1, with said apron thus abutting on its forward face against the rearward face of skirt 19 (see FIG. 11). In this relationship base flange 13 will be supported upon the upper face of body 3 of component 1 and due to the coincidence of angle of inclination of ribs 7 and of the angle of base flange 13 to portion 8 of component 2', the said flange 13 will thus be disposed in full seated disposition upon body 3 (FIG. 11). Such angle assures that any water or other liquid being deflected upon base flange 13 and body 3 of component 1 will flow through gravity downwardly and forwardly away from window B. With component 2' thus presented upon component 1, the former may then be moved laterally, or lengthwise of component 1 in order to present the face of portion 8 adjacent flange 15 into full abutment against the confronting face of jamb 25' and in such state flange 15 will overlie the adjacent edge portion of wall panel 30'. It is to be recognized that the distance between the proximate end edge of component 1 and the adjacent jamb 25,25', as the case may be, is less than the transverse extent of base flange 13 of the adjacent trim component 2 or 2', as the case may be, so that said flange 13 will rest upon the upper surface of body 3 in fully obscuring relationship to the gap (not shown) between component 1 and the jambs 25, 25'. Said trim component 2' is thus secured by suitable pressure sensitive material for adherence between portion 8 and the adjacent window jamb; between flange 15 and wall panel 30', as well as between base flange 13 and windowsill 26 and component 1. The utilization of such adhesive materials is well known and all areas so provided are not shown in the drawings, but are indicated at certain junctures, as at m, merely for purposes of exemplification.

Obviously, the other or remaining jamb trim component is disposed in operative position in the same manner as the trim component hereinabove described, although at the other end of component 1. The order of installing jamb trimming components 2,2' is without significance and the mere reference to mounting component 2' in detail is not to be construed as suggesting that in actual practice it should be necessarily mounted before the other or companion component.

From the foregoing it will thus be seen that trim assembly A is comprised of but three inter-related components which are adaptable for finishing or decorating window constructions which embody the conventional jambs and sill of the type more generally encountered in existing construction and in many residential buildings. The three parts of assembly A collaborate to permit of a facile installation which can be effected by the average home owner, not demanding developed skills. Furthermore, the same are so dimensioned that any window size may be easily and effectively accommodated.

The surface treatment of components 1, 2 and 2' is substantially limitless so that the same may be decorated for compatibility with any predetermined room decor or motif.

What is claimed is:

1. A window trim assembly for use with a building window having a sill and jambs at opposite sides of said window, for the purpose of modifying the appearance of said window, said assembly comprising a sill trim component for covering disposition of said sill including a main or body section of planar configuration and an apron depending from a horizontal edge of said main body portion for obscuring the adjacent edge portion of said sill, said apron having a planar configuration and being in substantially planar perpendicular relationship to said main or body section, and a pair of jamb trim components, each of said jamb trim components having a panel portion for covering disposition of corresponding portions of said jambs, each said panel portion being directed toward the opening of said window and being presented in upstanding relationship to the main or body section of said sill trim component, each said panel portion having a base extension projecting from said panel portion inwardly from the corresponding jamb member toward the opposite panel portion in overlying relation to the adjacent portion of the main or body section of said sill trim component, each base extension including a skirt integral with said base extension extending over the proximate portion of said apron of said sill trim component in covering disposition, and means securing together said sill trim component and jamb trim components.

2. A window trim assembly as defined in claim 1 wherein a plurality of transverse ribs are provided on the undersurface of said main or body section of said sill trim component, said ribs being in inclined relationship to said main or body section so as to be of lesser height adjacent said apron.

3. A window trim assembly as defined in claim 2 wherein said base extension of said jamb trim components is planarwise angularly related to the associated panel portion at substantially the same angle as the angle of inclination of said ribs.

4. A window trim assembly as defined in claim 1 wherein said jamb trim components each incorporate a lateral flange coextensive with the maximum dimension of the associated panel portion, said lateral flange being substantially planarwise perpendicular to said panel portion and to said base extension.

5. A window trim assembly as defined in claim 1 wherein a lip is provided on the lower end edge of each jamb trim component skirt and being turned inwardly beneath the lower edge of said apron.

6. A window trim assembly as defined in claim 1 wherein the panel portion of each jamb trim component contains opposed vertically extending forward and rearward longitudinal edges and upper and lower end edges, said base extension projecting from, and being continuous with, said lower end edge of said panel portion, a lateral flange continuous with said forward longitudinal edge being coextensive therewith and extending in a direction from the plane of said panel portion opposite that from which said base flange extends.

7. A window trim assembly as defined in claim 6 wherein each skirt is coextensive with the combined widths of said base flange and said lateral flange.

8. In combination with a room window having an external side and an inner side, said window having a sill and side jambs extending inwardly from the inner side thereof at opposite sides of said sill, a window trim assembly comprising a sill trim component having a main or body section of generally panel formation for disposition upon said window sill in covering relationship thereto, said sill trim component having also an apron depending from the window-remote side of said main or body section, a pair of jamb trim components each of which contains a panel portion for overlying disposition against the related window jamb for covering corresponding portions thereof, a base extension projecting from the lower end portion of the related panel portion for disposition overlyingly upon said sill trim component main or body section, and a skirt depending from an edge portion of said base extension for presentation occludingly of said apron and being of relatively greater vertical extent, and adhesive means for securing said jamb trim components to said window jamb and to said sill trim component and for securing said sill trim component upon said window sill.

9. The combination set forth in claim 8 wherein means are provided on said main or body section of the window sill trim component for disposing said section at an angle of less than 180° to the horizontal for liquid drainage purposes.

10. The combination as defined in claim 8 wherein a plurality of transversely extending ribs are provided on the undersurface of the main or body section of the sill trim component, said ribs inclining downwardly toward the apron thereby presenting said main or body section at an angle to the horizontal for promoting liquid gravity flow thereacross.

* * * * *